US009949550B2

(12) United States Patent
Bae

(10) Patent No.: US 9,949,550 B2
(45) Date of Patent: Apr. 24, 2018

(54) COSMETIC PENCIL

(71) Applicant: C&C INTERNATIONAL CO., LTD., Suwon-si (KR)

(72) Inventor: Eun-chul Bae, Yongin-si (KR)

( * ) Notice: Subject to any disclaimer, the term of this patent is extended or adjusted under 35 U.S.C. 154(b) by 0 days.

(21) Appl. No.: 14/946,487

(22) Filed: Nov. 19, 2015

(65) Prior Publication Data

US 2016/0360856 A1 Dec. 15, 2016

(51) Int. Cl.
*A45D 40/20* (2006.01)

(52) U.S. Cl.
CPC ..... *A45D 40/205* (2013.01); *A45D 2040/208* (2013.01)

(58) Field of Classification Search
CPC combination set(s) only.
See application file for complete search history.

(56) References Cited

U.S. PATENT DOCUMENTS 1,669,378 A * 5/1928 Lynn ..... B43K 21/085 401/76
2,559,906 A * 7/1951 Tursky ..... A45D 40/023 401/107
3,201,314 A * 8/1965 Morshauser ..... A45D 40/00 401/35
5,547,300 A * 8/1996 Powers ..... A45D 40/04 401/68
6,142,691 A * 11/2000 Crosta ..... A45D 40/04 401/68

* cited by examiner

*Primary Examiner* — David Walczak
(74) *Attorney, Agent, or Firm* — Robert W. J. Usher

(57) ABSTRACT

A cosmetic pencil includes a tubular body (10); a screw bushing (20) which is inserted and fixed to the body, and is formed with a threaded passageway (21) therein; a lead holder (30) which is threadingly engaged with the screw bushing (20) by a threaded portion (31), and is formed with a lead assembling socket (32) to receive a lead (2) at a front portion; and a rotator (40) fitted for rotation into a rear portion of the body, wherein the lead holder (30) is formed with a polygonal insertion opening (35) at a rear portion thereof in a longitudinal direction, and a front portion of the rotator (40) is formed with a polygonal insertion rod (45) inserted in the insertion opening (35) so that the lead holder (30) turns together with the rotator (40), and the lead (2) is extended from the body (10) while being turned in a spiral direction, preventing release of the lead from the lead holder.

4 Claims, 6 Drawing Sheets

COSMETIC PENCIL

FIELD OF THE INVENTION

The present invention relates to a cosmetic pencil for applying a cosmetic substance onto a face, for the purpose of highlighting an eye contour, eyebrows, a lip contour, and so forth, and more specifically, to a cosmetic pencil having a simple component structure, in which a lead and a lead holder are spirally rotated so that the lead is drawn out/extended from or retracted into a body.

BACKGROUND OF THE INVENTION

In general, cosmetic pencils of a pencil type are used to highlight an eye contour, eyebrows, a lip contour, and so forth, on a face.

In a case where a cosmetic lead is employed, the cosmetic pencil has various structures to propel the lead out from a body. As disclosed in Korean Utility Model Publication No. 20-0202796 and Korean Patent Publication No. 10-1440576, the cosmetic pencils have the configuration in which a lead holder for holding the cosmetic lead is inserted in the body, and the lead holder is spirally engaged to a rotator, so that the lead holder is moved back and forth by rotation of the rotator to propel the lead out from and back into the body.

Since the cosmetic pencils of the related art have the structure in which the cosmetic lead is drawn out/extended from the body by the axial movement, there is a problem in that the cosmetic lead is easily released from the lead holder.

That is, the cosmetic pencil of the related art has the problem in that, when the cosmetic lead is drawn out from or retracted into the body by the axial movement, in particular, when the lead is retracted into the body, the lead is frequently released from the lead holder.

In order to solve the above problem in that the cosmetic lead is released from the lead holder, a lead assembling hole of the lead holder is formed with a fixing boss for fixing the cosmetic lead, or various means for fixing the cosmetic lead. However, the structure of the lead holder is complicated. Also, the problem that the cosmetic lead is released from the lead holder is basically not solved by only improving the structure of the lead holder.

In addition, according to the cosmetic pencil of the related art, since the lead holder is threadingly engaged with the rotator, the structure of the rotator is complicated, and the assembling process thereof could hardly be performed. In order to solve the above drawback, U.S. Pat. No. 8,534,946 discloses that a part of a front portion of the rotator is cut away, and tension pieces operating inwardly and outwardly are formed with a threaded portion on its inner surface, so that the rotator is easily threadingly engaged with the lead holder. However, since the rotator is also complicated, there is a problem in that when the part is molded by a mold, poor molding occurs, and the productivity and the assembling workability are decreased.

SUMMARY OF THE INVENTION

Therefore, the present invention has been made to solve the above problems of the related art, and an object of the present invention is to provide a cosmetic pencil in which a lead is not axially moved with a lead holder, but is spirally turned to be drawn out/extended from a body, thereby preventing the lead from being released from the lead holder.

Another object of the present invention is to provide a cosmetic pencil in which a lead is made of a plurality of colors, thereby visually highlighting a marbling effect when the lead is spirally turned, and thus maximizing merchantability thereof.

Still another object of the present invention is to provide a cosmetic pencil of which the structure of the individual components is simple, thereby preventing poor molding of the components, and thus improving the productivity and the assembling workability.

According to one aspect of the present invention, there is provided a cosmetic pencil including: a tubular body; a screw bushing which is inserted and fixed to the body, and is formed with a threaded passageway therein; a lead holder which is threadingly engaged with the screw bushing by a threaded portion, and is formed with a lead assembling socket to receive a lead at a front portion; and a rotator which is rotatably fitted into a rear portion of the body, wherein the lead holder is formed with a polygonal insertion opening at a rear portion thereof in a longitudinal direction, and a front portion of the rotator is formed with a polygonal insertion rod which is inserted in the insertion opening of the lead holder, so that the lead holder is turned together with the rotator, and the lead is drawn out/extended from the body while being turned in a spiral direction.

Preferably, the polygonal insertion opening of the lead holder and the polygonal insertion rod of the rotator have complementary rectangular sectional structures.

Preferably, the lead is made of at least two colors.

With the above configuration of the cosmetic pencil, since the lead is not axially moved with the lead holder, but is spirally turned to be drawn out from the body, thereby preventing the lead from being released from the lead holder.

In addition, the lead is made of the plurality of colors, thereby visually highlighting a marbling effect when the lead is spirally turned, and thus obtaining an esthetic effect.

That is, as compared with the related art, merchantability thereof is maximized.

Also, since the structure of the components is simple, it is possible to prevent poor molding of the component and thus to improve the productivity and the assembling workability.

DETAILED DESCRIPTION OF THE PREFERRED EMBODIMENT

A preferred embodiment of the present invention will be hereafter described in detail with reference to the accompanying drawings.

Figure 1:
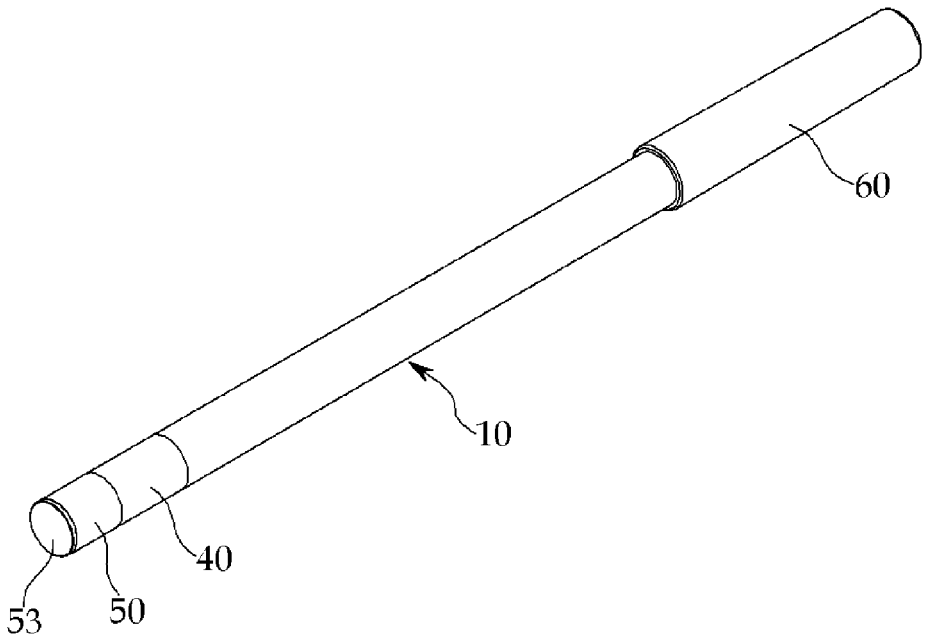
FIG. 1 is a perspective view illustrating a cosmetic pencil according to the present invention.
Figure 2:
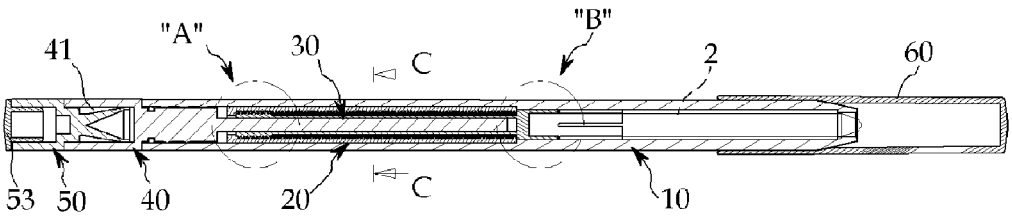
FIG. 2 is an axial cross-sectional view illustrating the cosmetic pencil according to the present invention.
Figure 3:
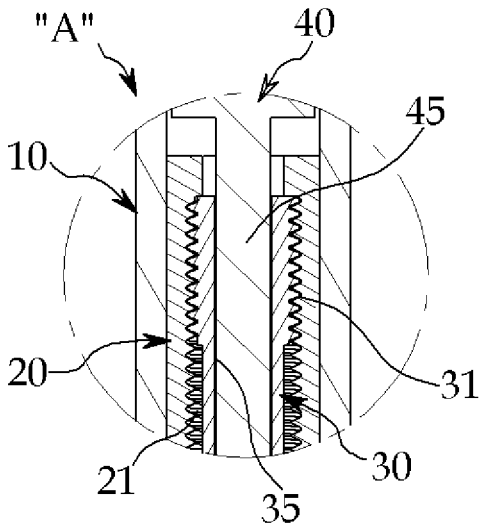
FIG. 3 is an enlarged view of the area A in FIG. 2.
Figure 4:
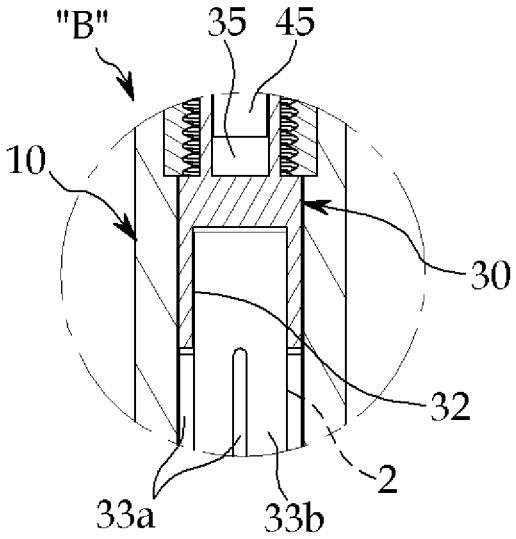
FIG. 4 is an enlarged view of the area B in FIG. 2.
Figure 5:
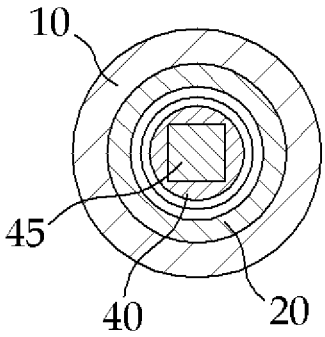
FIG. 5 is a cross-sectional view taken along the line C-C in FIG. 2.
Figure 6:
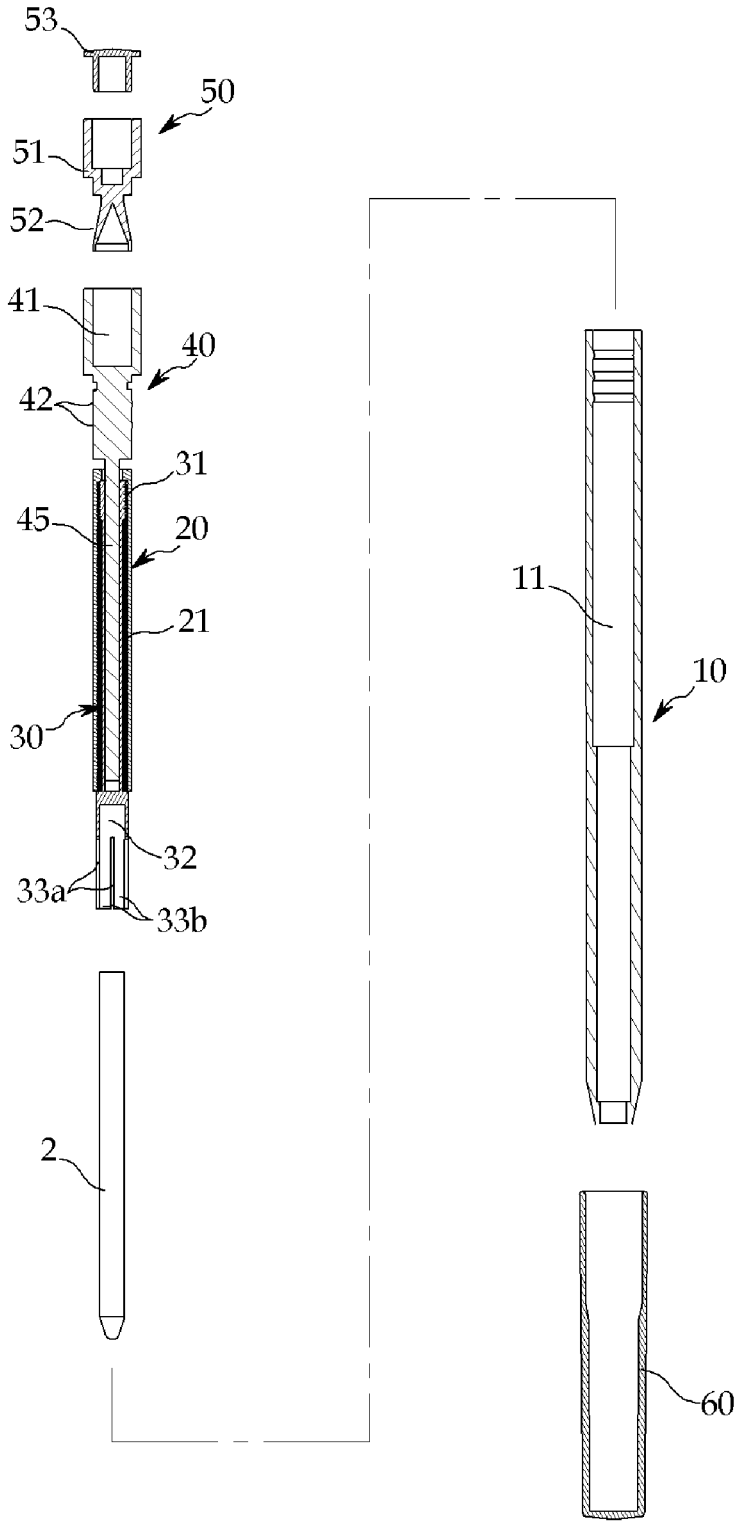
FIG. 6 is an exploded axial cross-sectional view illustrating the disassembled components of the cosmetic pencil shown in FIG. 2.
Figure 7:
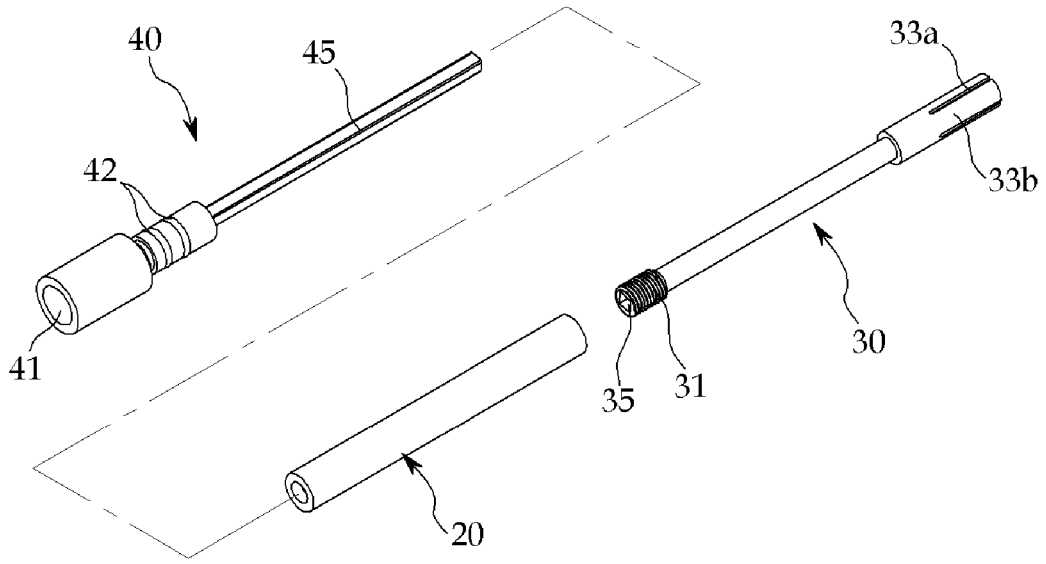
FIG. 7 is an exploded perspective view of major components of the cosmetic pencil according to the present invention.
Figure 8:
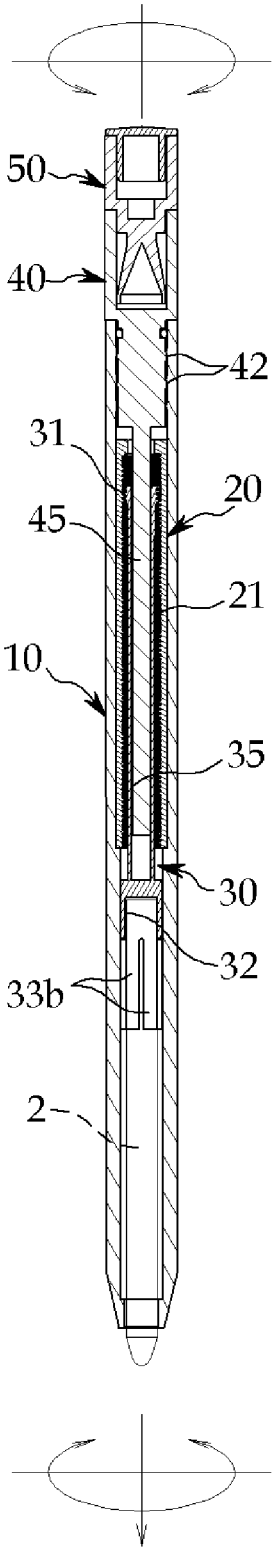
FIG. 8 is an axial cross-sectional view illustrating an operating state of the cosmetic pencil according to the present invention.

A cosmetic pencil of the present invention includes, as illustrated in FIGS. 1 to 7, a body 10, a screw bushing 20, a lead holder 30, a rotator 40, and a sharpener 50.

The body 10 has a tubular structure, and is formed with a stepped assembling passageway 11 of which a diameter of a rear inner portion is larger than that of a front inner portion.

The screw bushing 20 is inserted in the stepped assembling passageway 11 of the body in such a way that it is fixed to the body to prevent mutual rotation between the screw bushing and the body, and is itself formed with a threaded passageway 21.

The lead holder 30 is formed with a threaded portion 31 which is threadedly engaged with the threaded passageway 21 of the screw bushing 20, and also formed with a lead assembling socket 32, in which a lead 2 is seated, on a front portion thereof.

In this instance, tension pieces 33*b* operating inwardly and outwardly are segmented by slits 33*a* which are formed in a longitudinal direction, extending around the lead assembling socket 32 and thus the lead 2 is gripped by the tension pieces 33*b* when the lead is inserted.

That is, the lead assembling socket 32 is formed in such a way that the inner diameter portion of an opening having the tension pieces 33*b* protrudes slightly inwardly to form a stepped portion, thereby supporting the lead 2 with a gripping pressure.

Also, the lead holder 30 is formed with a polygonal insertion opening 35 at the rear portion thereof in the longitudinal direction.

The rotator 40 is inserted for axial rotation into a rear portion of the body 10, and a ring-shaped locking boss 42 protrudes from an outer circumferential portion of the rotator 40, and is inserted in the body 10 to prevent the rotator from being released from the body.

The front portion of the rotator 40 is formed with a polygonal insertion rod 45 which is inserted in the polygonal insertion opening 35 of the lead holder and is turned with the lead holder 30.

In this instance, the polygonal insertion hole 35 of the lead holder 30 and the polygonal insertion rod 45 of the rotator 40 can be correspondingly formed to have a sectional structure, such as a triangular, rectangular, or pentagonal shape, but the rectangular sectional structure is preferable in view of machinability, rigidity and assembling workability.

The rear portion of the rotator 40 is formed with an assembling groove 41 to receive the sharpener 50 therein, so that a user can take out and use the sharpener 50 if necessary.

The sharpener 50 has a handle body 51, a blade 52 to sharpen the lead 2 inserted in the handle body, and a plug 53 engaged to a rear portion.

The lead 2 is preferably made of at least two colors, but is not illustrated in the drawings.

A reference numeral 53 indicates a plug fitted into the sharpener, and 60 indicates a finishing cap.

The operation of the cosmetic pencil according to the present invention will be described.

First of all, a process of assembling the cosmetic pencil according to the present invention will be described.

The threaded portion 31 of the lead holder 30 is threadedly engaged with the threaded passageway 21 of the screw bushing 20, and the lead 2 is inserted into the lead assembling socket 32 of the front portion of the lead holder 30.

The polygonal insertion rod 45 of the rotator 40 is inserted and assembled to the polygonal insertion opening 35 of the rear portion of the lead holder 30.

The lead holder 30 is fitted into the rear portion of the tubular body 10, and the screw bushing 20 is inserted and fixed to the stepped assembling hole 11 for the purpose of mutual rotation.

The sharpener 50 is assembled to the assembling groove 41 of the rear portion of the rotator 40.

The cosmetic pencil of the present invention which is assembled by the above process includes the body 10, the screw bushing 20, the lead holder 30, the rotator 40, and the sharpener 50. In particular, the lead holder 30 is not operatively engaged with the rotator 40 to provide longitudinal movement, but is threadedly engaged with the screw bushing 20. Therefore, since the structures of the rotator 40 and the screw bushing 20 are simplified, it is possible to prevent poor molding of the components, and thus the productivity thereof and the assembling workability are improved.

It should be known that the order of assembling the components can be changed.

The cosmetic pencil of the present invention which is assembled by the above process can propel the lead 2 out from the body 10.

That is, if the rotator 40 is turned, the polygonal insertion rod 45 of the rotator 40 is fitted into the polygonal insertion hole 35 of the lead holder 30, and thus the lead holder 30 is turned.

If the lead holder 30 is turned, since the threaded portion 31 of the lead holder is threadedly engaged with the threaded passageway 21 of the screw bushing 20, the lead holder is not moved in a straight way, but is axially moved while being spirally turned.

In this instance, the polygonal insertion rod 45 of the rotator 40 which is inserted in the polygonal insertion socket 35 of the rear portion of the lead holder 30 serves as a guide for the lead holder 30 which is axially moved, so that the lead 2 can be stably moved in an axial direction.

As the lead holder 30 smoothly propels the lead 2, which is inserted in the lead assembling socket 32, not by moving the lead in only the axial direction, but by spirally turning the lead, the lead 2 is prevented from being released from the lead assembling socket 32 of the lead holder.

Even though there is no separate component for fixing the lead to the lead assembling socket 32 of the lead holder, the spirally turning method of the lead holder 30 can solve the problem in of preventing the lead 2 being released from the lead assembling socket 32 of the lead holder.

In addition, the lead 2 is made of the plurality of colors, and the lead is drawn out from the body 10 not by the axial movement, but by the spiral turning, thereby visually highlighting a marbling effect, and thus obtaining an additional esthetic effect of the lead.

While the present invention has been described with reference to the particular illustrative embodiment, it is not to be restricted by the embodiment but only by the appended claims. It is to be appreciated that those skilled in the art can change or modify the embodiments without departing from the scope and spirit of the present invention.

The invention claimed is:

1. A cosmetic pencil comprising:

a tubular body (10);

a screw bushing (20) which is inserted and fixed to the body, and is formed with a threaded hole (21) therein;

a lead holder (30) which is threadedly engaged with the screw bushing (20) by a threaded portion (31), and is formed with a lead assembling hole (32) receiving a lead (2) at a front portion; and a rotator (40) which is rotatably fitted into a rear portion of the body, wherein the lead holder (30) is formed with a polygonal insertion hole (35) at a rear portion thereof in a longitudinal direction, and a front portion of the rotator (40) is formed with a polygonal insertion rod (45) which is inserted in the insertion hole (35) of the lead holder, so that the lead holder (30) is turned together with the rotator (40), and the lead (2) is drawn out from the body (10) while being turned in a spiral direction.

2. The cosmetic pencil according to claim 1, wherein the polygonal insertion hole (35) of the lead holder (30) and the polygonal insertion rod (45) of the rotator (40) have a rectangular sectional structure corresponding to each other.

3. The cosmetic pencil according to claim 2, wherein the lead (2) is made of at least two colors.

4. The cosmetic pencil according to claim 1, wherein the lead (2) is made of at least two colors.

* * * * *